United States Patent [19]

Deeds

[11] 4,054,132

[45] Oct. 18, 1977

[54] INTEGRATED DIVING SYSTEM

[76] Inventor: Douglas Allen Deeds, 1706 W. Arbor Drive, San Diego, Calif. 92103

[21] Appl. No.: 568,011

[22] Filed: Apr. 14, 1975

[51] Int. Cl.[2] ..... A62B 7/00

[52] U.S. Cl. ..... 128/142 R; 9/316; 9/339; 114/16 E

[58] Field of Search ..... 128/142, 142.2, 142.3, 128/145 R, 145 A, 142.7, 145.8; 9/316, 319, 336, 337, 339, 340, 342, 313, 330, 329; 114/16 E, 16 R, 16.8, 16.4, 16.7; 2/2.1 R

[56] References Cited

U.S. PATENT DOCUMENTS

| | | | |
|---|---|---|---|
| 1,035,021 | 8/1912 | Laubeuf | 114/16 E |
| 2,864,101 | 12/1958 | Kissenberger | 9/339 |
| 3,105,359 | 10/1963 | Ellis | 61/70 R |
| 3,436,777 | 4/1969 | Greenwood | 9/313 |
| 3,683,835 | 8/1972 | Deslierres | 114/16.4 |
| 3,727,250 | 4/1973 | Koehn et al. | 9/313 |
| 3,866,253 | 2/1975 | Sinks et al. | 128/142 |
| 3,898,705 | 8/1975 | Schuler | 9/313 |

*Primary Examiner*—Robert W. Michell
*Assistant Examiner*—Henry J. Recla
*Attorney, Agent, or Firm*—Edward E. Roberts

[57] ABSTRACT

An integrated Scuba diving system embodying in one unit the back pack, shoulder harness, waistband, weight belt, tank holder, and buoyancy compensator. A molded monocoque structure forms the back pack and tank holder, and contains therein the buoyance compensator bag (bladder). The buoyance compensator of the invention features a single valve which embodies in one simple unit the functions of inflation, deflation, vent and over pressure.

6 Claims, 4 Drawing Figures

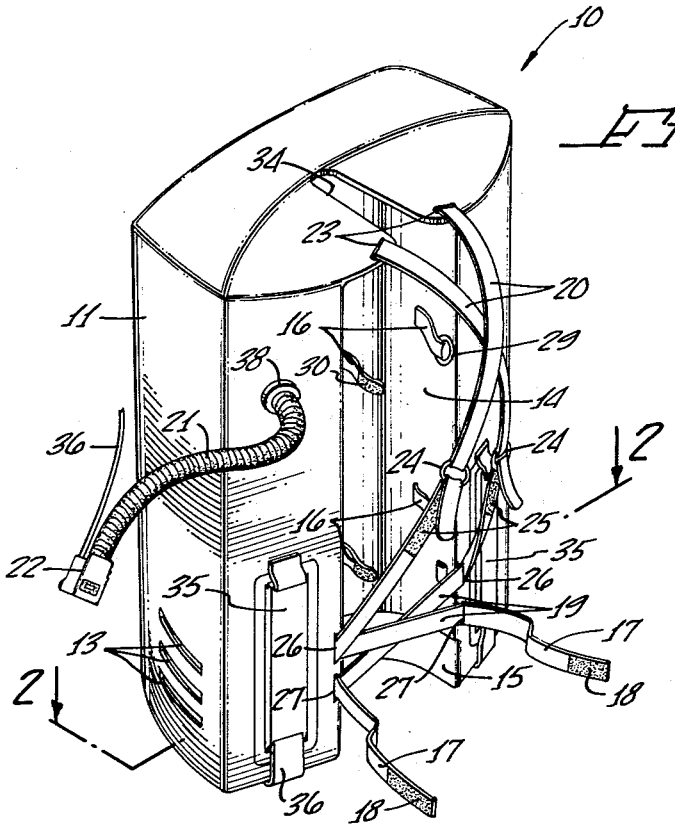
FIG. 1.
FIG. 2.
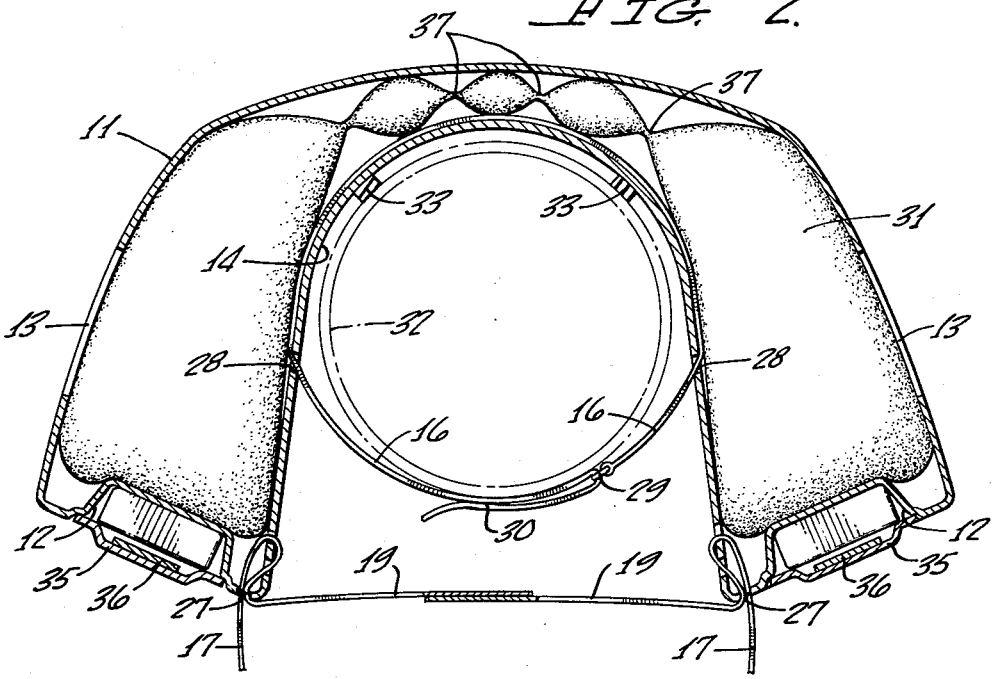

FIG. 3.
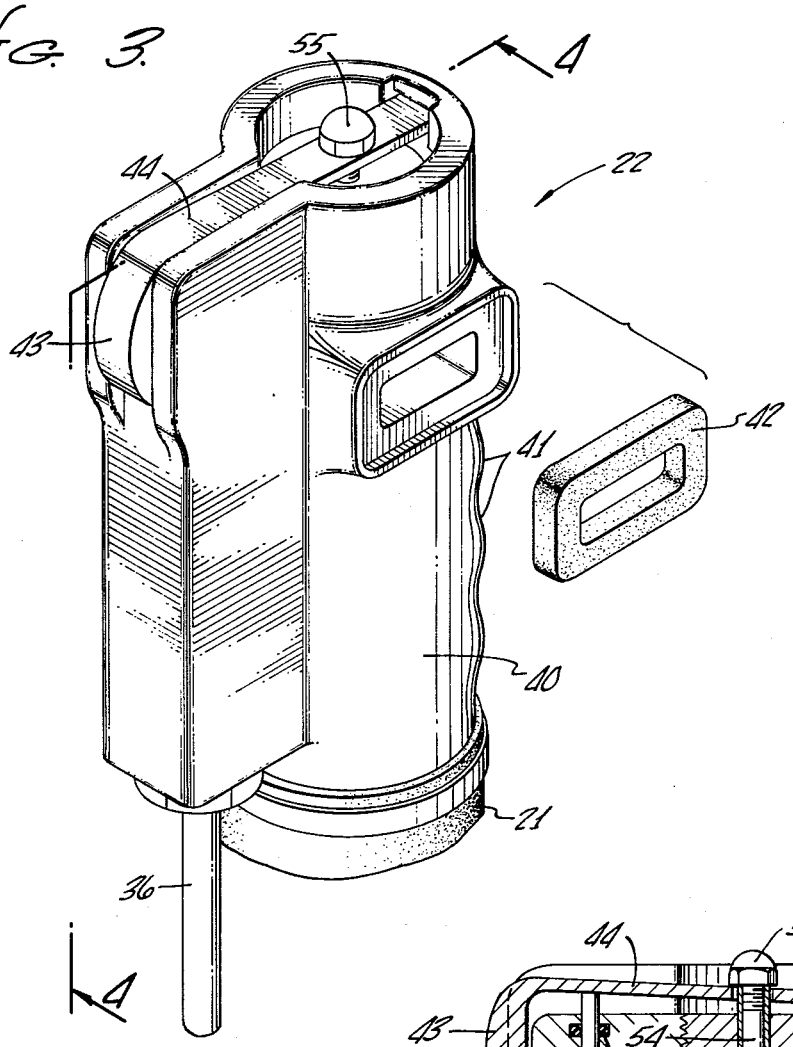
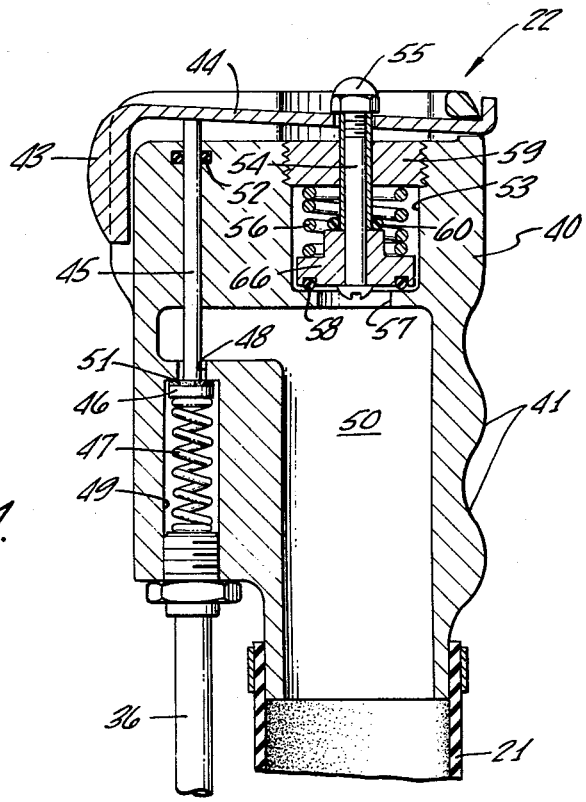
FIG. 4.

INTEGRATED DIVING SYSTEM

BACKGROUND OF THE INVENTION

1. Field of the Invention

The present invention relates to new and useful improvements in Scuba diving equipment and more particularly to an integrated diving system wherein the back pack, shoulder harness, waistband, weight belt, tank holder and buoyance compensator are integrated into one system.

2. Description of the Prior Art

Various types of Scuba diving components are presently on the market which are assembled according to individual preference to make up the desired package for the diver. In general the tank, back pack, weight belt, buoyance compensator, regulator, etc., are separate units manufactured by various companies which are randomly purchased and assembled for use by the diver.

As may be appreciated, it is desirable to have an integrated unit providing the necessary functions that greatly simplifies and makes easier the divers donning, operating and removing of the Scuba equipment. Applicant's integrated unit further provides a greater margin of safety throughout the dive than would the assembly of components of the prior art.

SUMMARY OF THE INVENTION

An integrated Scuba Diving system with hardware to perform the functions of a back pack, shoulder harness, waistband, weight belt, tank holder, and buoyance compensator. Applicant's apparatus comprises a molded monocoque shell which carries all of the system structural loads and incorporates molded contours and configurations that provide other features of the system including back pack, tank cradle, water entry gills and weight compartments. The shell contains the bouyance compensation bladder and weights, has appropriate straps for waist and shoulder, and features a tank inflation valve which integrates into one simple unit the inflation, deflation, vent and overpressure functions of a buoyance compensator valve. The shell is of molded plastic material and is hydrodynamically shaped for ease of swimming.

BRIEF DESCRIPTION OF THE DRAWINGS

FIG. 1 is a perspective view of the integrated diving system in accordance with the invention.

FIG. 2 is a section along the lines 2—2 of FIG. 1 with the tank added.

FIG. 3 is a perspective view of the integrated buoyance compensator valve in accordance with the invention.

FIG. 4 is a section along the lines 4—4 of FIG. 3.

DETAILED DESCRIPTION

Referring to FIG. 1 there is shown a perspective view of integrated diving system 10. As will be appreciated by those skilled in the art, the integrated diving system 10 may be varied from the system shown, however, FIG. 1 illustrates a preferred embodiment of applicant's invention.

The shell 11 is a monocoque stressed skin shell and carries the structural loads of the system and incorporates therein molded contours and configurations that provide other features of the system. Shell 11 includes the weight compartments 12 (with cover), water entry gills 13 (positioned both sides or as needed), the compressed air tank cradle 14 shown with a cradle relief 15 for tank boot clearance, tank straps 16, adjustable waist belt 17 with hook and pile hold-upon-contact engagement means 18, back sling 19, adjustable shoulder straps 20, and inflation hose 21 attached at one end to shell 11. At the other end of inflation hose 21 there is shown integrated valve 22 that combines the functions of inflation of the buoyance bladder 31, deflation of the buoyance bladder, and automatic release of over pressure in the buoyance bladder. The buoyance bladder 31 is more clearly shown in FIG. 2. Integrated valve 22 is more clearly shown in FIGS. 3 and 4.

The structure of the shell 11 in conjunction with the tank 32 and the straps 16, 17, 18, 19 and 20 creates a harness network providing a back pack of comfort and simplicity. As shown in FIG. 1, slots are provided in the shell 11 to allow the anchoring, installation and adjustment of the harness network and back pack formed by the straps 16–20. Straps 20, passing through slots 23, cross to form the shoulder straps which are easily adjusted by use of the rings 24 and the closures 25. Closures 25 provide for hook and pile, hold-upon-contact, areas such as manufactured by Velcro. The shoulder straps then pass through slots 26 and across the tank cavity/cradle 14 and through a similar set of slots 27. The crossing of these straps creates a back sling support 19 for the lower part of the diver's back. The excess length of strap on each side forms the waist belt 17. The waist belt 17 is easily adjusted and closed by virtue of the hook and pile hold-upon-contact areas 18. The contact areas 18 and 25 provide instant release when ripped apart in an emergency requiring jettesoning of the entire system. The tank cradle 14 is angled in such a way as to allow the tank to be clear of the back sling 19, yet at the top of the cavity allow the tank to protrude enough to provide comfort and support between the shoulders of the diver. The tension of the back sling 19 is adjustable by slipping the straps through the slots and taking up the excess in the waist belt.

As shown in FIGS. 1 and 2, the front of the monocoque shell 11 is contoured in such a way as to provide the cradle 14 for the securing of the air tank 32 into the system. This cradle is concavely formed in the shell and accomodates all sizes of tanks, either 50, 72, or 80 cubic feet, aluminum or steel. The slope of the cradle 14 and mounting of tank 32 therein allows easy access to the standard combination tank outlet valve and "J" valve reserve lever (not shown) which is mounted at the top of the tank, and to the low pressure regulator first stage (not shown) which is connected to the tank outlet valve prior to use. All air described below as coming from the tank first is pressure regulated by the regulator.

Two factors combine to secure the tank in the cradle. The back of the cradle has strips 33 (FIG. 2) of flexible foam material affixed to the shell surface which prevent the tank from slipping when the tank straps 16 are tightened around the tank. As shown in FIG. 2, the tank strap 16 is passed through a slot 28 in the side of the tank cradle, inside the shell, through an opposing slot 28 and then around the tank. As shown in FIG. 1 there are two sets of such straps 16, one toward the top of the shell and underneath the shoulder strap cross-over, and one toward the bottom of the shell slightly above the cradle relief 15. Tightening of the tank straps is accomplished by passing the tail of each strap through the ring 29 of the strap, cinching up the strap, and then securing the strap to the hook and pile portion 30 of the strap.

Removal of the tank from the cradle is accomplished by simply ripping open the hook and pile portion of the straps 16 which leaves the tank free to be separated from the cradle. When inserting or removing the tank, the straps 16 can be kept out of the way by mating of the hook and pile portions of the straps to hook and pile tabs (not shown) mounted in the cradle or by passing the bottom strap 16 (closest to the cradle relief 15) through the gaps on each side of the back sling 19. It is seen that this tank holding method provides simple, quick release and easy tank change. Further, this method will hold the tank in place in the cradle even if the straps 16 become loose since the contour of the top of the shell where the tank neck fits (opposite end from the cradle relief 15) provides a slot 34 which constrains the tank outlet valve to prevent the tank from slippling down even if the straps become loose. Also provided is the moulded tank cradle 14 and tank cradle relief 15 in the shell 11 which is contoured to fit snugly around the tank.

Molded into the bottom or sides of the shell 11 are weight compartments 12 (best shown in FIG. 2) which can accomodate a variety of weights such as standard weight belt weights, custom molded weights fitting the compartment, or bags of shot. The weights are retained in the compartment(s) 12 by door(s) 35 (best shown in FIG. 1) affixed to the shell 11 by strap(s) 36 threaded through a system of slots in the shell 11 and the door(s) 35. The strap(s) 36 emerge from the door(s) 35 at the bottom of the door and then are attached to the shell 11 by mating, matching hook and pile areas of the strap to hook and pile tabs on the shell. Release of the weights is thus accomplished by ripping these hook and pile portions apart. For trim, adjustment of the weights is accomplished by relocating the weight retention clip(s) (not shown) to a selected set of holes (not shown) in the strap(s) 36 running on the underside of the door(s) 35. If desired, additional weights may be affixed to the inside or outside of the shell and secured by strap/latch designs readily ascertainable by those well versed in the art. Additional ejection could be provided by spring(s) mounted under the weights.

Integrally mounted into the shell 11 are water entry grills 13 which are designed to allow the free passage of water and/or air into or out of the shell. These gills are shown located on the sides of the shell 11 but may be located elsewhere such as at the bottom of the shell or on the sides of the tank cavity 14.

The buoyance compensator portion of the system is comprised of the buoyance bag/bladder 31 (FIG. 2), the inflation hose 21, the integrated valve 22 (FIGS. 3 and 4), and the regulator hose 36. The buoyance bag 31 can be inflated within the shell 11 either orally through valve 22 or from the tank through regulator hose 36 and valve 22, as will be evident upon reading the discussion, infra.

The buoyance bag 31 can be tailored to the interior contour of the shell 11 although this is not required since the shell forces the bag to conform as it is inflated. The bag can be inserted into the shell originally through a hole (not shown) in the top/back of the tank cavity and can be secured in the shell by means of lanyards (not shown) attached to the bag that are passed through holes adjacent the weight compartments and tied off. The lanyards and the top of the tank retain the bag preventing expansion of the bag out of the insertion hole. The bag 31 in FIG. 2 is shown tailored to the shell 11 with appropriately tailored seals 37.

In the prior art equipment the over pressure valve has been cumbersome, complicated and/or restricted in flow and has been located in the buoyance bag or as a separate fitting in the inflation line or as a separate valve in the control piece. In the design of the applicant, the valve 22 combines the over pressure and deflation/vent valve into one valve resulting in improved flow and simplified operation. As will be explained infra it is possible in an emergency to breathe through valve 22 and obtain air either from the tank or the bouyancy bag.

The valve 22 comprises a housing 40 having contoured hand grips 41 that provide for an easy, fast, natural grip of the housing for comfortable, proper grip of the unit. The inflation hose 21 is optionally connected to come over the right shoulder of the driver with the valve housing mounted for gripping by the right hand such that the oral inflation mouthpiece is located in a natural position for easy access. One button, one digit valve function control is provided by single thumb button 43. The button 43 is moved either up or down in operation of integrated valve 22, a down movement providing for air to enter the valve 22 from the tank 32 and an up movement providing for air passage between the mouthpiece 42 and the buoyance bag 31. The hose 21 can be mounted as desired on the shell 11.

The inflation valve of the integrated valve 22 allows air from the compressed air tank 32 to inflate the buoyance bag 31. By movement of the thumb buttom 43 in the down direction, lever arm 44, affixed to thumb button 43, and held in place by nut 55 and housing 11, forces valve stem 45 and valve seat 46, attached to valve steam 45, against spring 47 to thereby open the air passage 48 between housing chamber 49 and 50. Air from the tank 32 is fed to chamber 49 through air hose 36 which is mated to the housing 40 and chamber 49 by any suitable means for the purpose. Air passing from chamber 49 to chamber 50 with the thumb button 43 in the down position is then fed through air hose 21 to the buoyance bag 31. When the thumb button 43 is returned to the neutral position the pressure from spring 47 combined with the air pressure from tank 32 returns valve seat 46 to its former position. Complete seal of the air passage 48 is effected by O-ring 51 positioned to the housing side of valve seat 46.

Air is prevented from escaping from the housing 40 through the valve stem passage area leading to the lever 44 because of the seal 52. Further, with the thumb button in the down position the deflate/over pressure valve is closed to prevent air in chamber 50 from passing into chamber 53 and thus out through mouthpiece 42. When the thumb button 43 is moved to the up position the lever 44 slides along spacer tube 61 until contact is made with nut 55. As thumb button 43 is pushed into and held in the up position, valve seat 66 is pressed against spring 56 which compresses against housing 40 and plug 59 to allow the air passage 57 to open between chamber 50 and chamber 53, thus allowing for the passage of air between chamber 50 and the mouthpiece 42. In this condition, the bag 31 can be inflated by orally forcing air into the mouthpiece, through chamber 53, passage 57, chamber 50 and on to bag 31 by means of hose 21. When the thumb button 43 is released and returned to the neutral position, spring 56 forces valve seat 66 back against the housing 40 and the seal is completed by O-ring 58.

It is thus seen that in an emergency situation air can be breathed from the bag 31 by holding the thumb button in the up position. For instance, the button could be positioned in the down position to feed air into the bag 31 and then held in the up position to breathe air from the bag through mouthpiece 42 which is constructed as a foam rubber insert partially recessed into the housing 40.

When the air pressure in the bag 31 is caused to reach an over-pressure condition because of an ascent by the diver (with corresponding increase of air pressure in bag 31) or by inadvertent over-pressure Applied from the tank, rupture of the bag is prevented by prior adjustment of the spring pressure of spring 56 to allow venting of air from the bag 31. Thus, an over-pressure condition in the bag 31 overcomes the spring pressure of spring 56 and the over-pressure escapes from mouthpiece 42. This is true even if the thumb button 43 is in the down position with the inflation portion of the valve activated. Further, the vent valve portion of the integrated valve 22 is self-adjusting for hydrostatic pressure changes. This is true since the water pressure is constantly applied through the mouthpiece 42, into chamber 53 and onto the back face/spring side of valve seat 66.

The integrated valve of applicant provides improved depth stabilization which is important to the diving working at a desired depth or if he is decompressing at a necessary depth. By simple easy one-digit operation of the thumb button 43 working against the springs 47 and 56, smooth sensitive control of the passage of air passage to and from the bag 31 is effected to thus maintain the desired depth within close tolerance.

The integrated valve is designed for ease of manufacture, maintenance and repair. The housing 40 can be made of plastic material or metal and can be an assembly of machined parts or cast or molded. Machining operations are easily performed because of the simple design. The lever 44 can be made of flexible material held in place as shown by nut 55 and housing 11, the lever end opposite the thumb button being engaged and fixed into housing 11 in any suitable manner as shown in FIG. 3. Hose 36 can be threaded into chamber 49 as shown and plug 59 threaded into chamber 53. Valve stem 54 slides easily through spacer tube 61 within plug 59 with O-ring 60 acting as a seal.

Thus there has been shown an integrated diving system comprising exemplary structural assembly. However, the invention is not limited to the exemplary features, for those skilled in the art will readily achieve modifications which are within the sprit and scope of the invention. Rather, the invention is limited only by the claims appended hereto.

What is claimed is:

1. Integrated breathing apparatus for an underwater diver for use with a compressed air tank and an air pressure regulator attached thereto, comprising:

a molded stressed skin monocoque shell having a plurality of hollow interior portions formed with a concave exterior cradle for accepting said tank, restraining means for selectively positioning said tank in said cradle;

harness means for attaching the shell to the back of a diver, water entry means in said shell permitting bi-directional passage of water to and from said interior portions of said shell;

buoyancy compensation weights positioned in weight compartments selectively molded into said shell, means for manually ejecting said weights from said compartments;

a buoyancy bladder for buoyancy compensation fitted in said hollow interior portions;

a buoyancy compensator valve connected by first hose means to said buoyancy bladder and by second hose means to said air pressure regulator attached to said tank and having control means for selectively transferring pressure regulated air from said air pressure regulator to said bladder;

said control means including means for selectively transferring air from said bladder to atmosphere, said compensator valve including mouth piece means for orally inflating said bladder, said control means including means for automatic release of over pressure from said buoyancy bladder;

said buoyancy compensator valve comprising first, second and third interior chambers in a suitable housing, said first chamber connected to said second hose to thereby receive air from said air pressure regulator therethrough, first control means for controlling the passage of air through a first air passage connected between said first chamber and said second chamber, said second chamber connected to said first hose to provide air to said buoyancy bladder therethrough, second control means for controlling the passage of air through a second air passage connecting said second chamber and said third chamber, said third chamber connected to said mouthpiece means for the passage therethrough of air into or out of said valve, said first and second control means providing independent control over air flow through the respective passages;

said first control means includes a lever arm in contact with a first valve stem having a first valve seat spring-loaded with a first spring whereby the positioning of said lever arm in a first position applies force to said first valve stem to force said first valve seat against said first spring to thereby open said first air passage, said first valve seat and said first spring being located in said first chamber; and said second control means includes said lever arm in contact with a second valve stem having a second valve seat spring-loaded by a second spring whereby the positioning of said lever arm in a second position applies force to said second valve stem to force said second valve seat against said second spring to thereby open said second air passage, said second valve seat and said second spring being positioned in said third chamber.

2. The integrated breathing apparatus of claim 1 wherein said first and said second springs apply through said first valve stem and said second valve stem respectively, opposite acting forces to said lever arm thereby positioning said lever arm in a neutral position in the absence of manually applied force to said lever arm, the movement of said lever out of said neutral position into either of said first position or said second position being independent movement against said first spring or said second spring respectively, thereby providing close tolerance control of the independent opening of said first air passage and said second air passage respectively.

3. The integrated breathing apparatus of claim 2 wherein said lever arm is positioned in said first position thereby opening said first air passage and providing air from said tank to inflate said bladder and then positioned in said second position thereby opening said second air passage and providing air from said bladder at said mouthpiece means whereby the diver can breathe from said bladder.

4. The integrated breathing apparatus of claim 1 wherein the spring pressure of said second spring is adjusted such that a preselected air pressure in said second chamber resulting from over-pressure in said bladder will overcome said spring pressure to open said second air passage to thereby vent said through said mouthpiece means bladder.

5. The integrated breathing apparatus of claim 1 wherein;

said first valve stem extends from said first interior chamber through said housing into engagement with said lever arm, said second valve stem extends from said third interior chamber through said housing into engagement with said lever arm.

6. The integrated breathing apparatus of claim 1 wherein;

said mouthpiece means and said buoyancy bladder communicate via said third interior chamber means such that air from said buoyancy bladder means can escape from said mouthpiece as a function of the relative pressures applied to opposite sides of said second valve seat.

* * * * *